US012594459B2

(12) United States Patent
Davignon

(10) Patent No.: US 12,594,459 B2
(45) Date of Patent: Apr. 7, 2026

(54) APPARATUS FOR INCLINED PUSH-UPS

(71) Applicant: Barry Jay Davignon, Terre Haute, IN (US)

(72) Inventor: Barry Jay Davignon, Terre Haute, IN (US)

( * ) Notice: Subject to any disclaimer, the term of this patent is extended or adjusted under 35 U.S.C. 154(b) by 147 days.

(21) Appl. No.: 18/610,889

(22) Filed: Mar. 20, 2024

(65) Prior Publication Data

US 2025/0295951 A1 Sep. 25, 2025

(51) Int. Cl.
*A63B 23/12* (2006.01)
*A63B 21/00* (2006.01)

(52) U.S. Cl.
CPC ..... *A63B 23/1236* (2013.01); *A63B 21/4035* (2015.10)

(58) Field of Classification Search
CPC ..... A63B 21/00047; A63B 21/068; A63B 21/4035; A63B 23/1236; A63B 2208/0295; A63B 2209/00
See application file for complete search history.

(56) References Cited

U.S. PATENT DOCUMENTS

| | | | | |
|---|---|---|---|---|
| 5,181,897 | A | 1/1993 | Agan | |
| D354,100 | S | 1/1995 | Tsay | |
| 5,466,206 | A | 11/1995 | Fleming | |
| 5,527,252 | A | 6/1996 | Sather | |
| 5,749,818 | A | 5/1998 | Sather | |
| 7,585,262 | B1 * | 9/2009 | Vayntraub | A63B 21/4035 482/141 |
| D631,106 | S * | 1/2011 | Zemel | D21/662 |
| 7,909,746 | B2 * | 3/2011 | Gant | A63B 21/4019 482/141 |
| 8,105,218 | B1 * | 1/2012 | Vayntraub | A63B 23/1236 482/141 |
| 8,343,021 | B1 | 1/2013 | Seraydarian | |
| 8,382,647 | B1 * | 2/2013 | Hodes | A63B 21/072 482/141 |
| 8,454,485 | B1 * | 6/2013 | Hodes | A63B 21/072 482/141 |
| 10,695,610 | B2 | 6/2020 | Barrie | |
| 2010/0210430 | A1 * | 8/2010 | Mulderrig | A63B 21/4017 482/141 |

(Continued)

FOREIGN PATENT DOCUMENTS

| | | | | |
|---|---|---|---|---|
| KR | 20230161035 A * | 11/2023 | | A63B 22/16 |
| WO | WO-2014022263 A1 * | 2/2014 | | A63B 23/1236 |

*Primary Examiner* — Gary D Urbiel Goldner

(57) ABSTRACT

An exercise apparatus for performing inclined push-ups on stairs or on an incline in general, wherein the exercise apparatus comprises a pair of push-up stands. Each push-up stand comprises a handle and an arcuate support member having an anti-slip, high friction, outer convex surface. When used on the stairs, the exercise apparatus is positioned on an inside corner of the stairs, wherein the arcuate support member is supported by contact with a stair riser and an adjacent stair tread through friction. Alternatively, a general structure can be used if it has an inside corner formed by adjacent horizontal and vertical surfaces. Having the exercise apparatus supported by friction allows a user to position the exercise apparatus at a comfortable inclined angle. Doing push-ups on an incline requires less force than conventional push-ups which benefits users who struggle with conventional push-ups.

6 Claims, 7 Drawing Sheets

(56) References Cited

U.S. PATENT DOCUMENTS

| | | | | |
|---|---|---|---|---|
| 2010/0279833 | A1* | 11/2010 | Gant | A63B 21/00047 482/141 |
| 2013/0190150 | A1* | 7/2013 | Delisle | A63B 21/075 482/141 |
| 2014/0038795 | A1* | 2/2014 | Sassano | A63B 22/18 482/141 |
| 2017/0007878 | A1* | 1/2017 | Cox | A63B 21/4035 |
| 2019/0168060 | A1* | 6/2019 | Laurence | A63B 21/06 |
| 2022/0233915 | A1* | 7/2022 | Allen | A63B 23/1236 |
| 2022/0339491 | A1* | 10/2022 | Azzam | A63B 21/4035 |

* cited by examiner

APPARATUS FOR INCLINED PUSH-UPS

PRIOR ART

Several exercise apparatuses have been used to facilitate the performance of push-ups on stairs or on an incline. For instance, U.S. Pat. Nos. 5,527,252 and 5,749,818 to Sather disclose an apparatus which has two supporting members for handgrips rigidly connected to a center cross brace. The disadvantages of this apparatus include; the apparatus is not compact for storage, the lateral spacing for the handgrips is fixed and cannot be varied, and the angle of the handgrips relative to the angle of the incline is fixed and cannot be varied. Having the ability to adjust the angle of the user's hand, relative to the angle of the incline, provides better comfort to a user especially in the user's wrists and shoulders. U.S. Pat. No. 8,343,021 to Seraydanan discloses an apparatus for inclined push-ups on stairs, however this apparatus is designed for a specific type of stair, namely stairs with cove molds. Also, with this apparatus the angle of the handgrips relative to the angle of the incline is fixed and cannot be varied. U.S. Pat. No. 5,181,897 to Agan, U.S. Pat. No. Des354,100 to Tsay and Zhang and U.S. Pat. No. 10,695,610 B2 to Barrie disclose push-up stands for stairs. All these apparatuses use an outer corner of the stairs for support and don't allow the user to adjust the angle of the handgrips relative to the angle of the incline. U.S. Pat. No. 5,466,206 to Fleming discloses push-up stands for an elevated surface. With this apparatus the angle of the handgrips relative to the angle of the incline is fixed and cannot be varied.

BACKGROUND OF THE INVENTION

The present invention relates generally to an exercise apparatus, and more specifically to an exercise apparatus for inclined push-ups, preferably on stairs. Conventional push-ups are an excellent exercise for building arm and upper body strength as well as to improve cardiovascular health. Many users, for various reasons, don't have the strength for conventional push-ups. The reasons include old age, being overweight, not being in shape, having an injury, and other reasons. Push-ups performed on an incline require less force than conventional push-ups and present a viable option for many users. Using stairs as an inclined support has the advantage that most users have ready access to stairs and that stairs are very stable and unlikely to move or shift.

SUMMARY OF THE INVENTION

This summary is intended to disclose the present invention, an inclined push-up exercise apparatus which facilitates inclined push-ups on stairs or on an incline in general. The present invention comprises two individual push-up stands, one for each hand of a user. Each push-up stand comprises two main components, an arcuate support member, and a handle. The arcuate support member is a structural member that includes anti-slip, high friction surfaces, especially on the outer, convex surface. The handle is mounted across the two opposite ends of the arcuate support member. For use on stairs, the exercise apparatus is positioned on an inside corner of the stairs, where the arcuate support member contacts a horizontal stair tread and an adjacent vertical stair riser. The exercise apparatus is held in position by friction between the arcuate support member and adjacent horizontal and vertical surfaces of the stairs. By having the exercise apparatus held in position by friction against the stairs, the user can set an angle of the exercise apparatus to a comfortable position before starting the inclined push-ups. The angle of the exercise apparatus is the relative angle of the exercise apparatus in relation to the slope angle of the stairs. Not having the exercise apparatus at an optimal angle can cause discomfort to the user especially in the user's wrist and shoulders. For use on an incline in general, the arcuate support member is positioned on an inside corner formed by a horizontal surface and an adjacent vertical surface. Because the exercise apparatus is comprised of two individual push-up stands, the user can set a lateral spacing between the push-up stands before starting the inclined push-ups. The lateral spacing of the push-up stands can determine the user's comfort and can target different muscles. The arcuate support member has the strength to support the weight of the user. A preferred method of manufacture of the arcuate support member comprises, cutting a blank from a flat sheet of rubber and curving the ends of the blank into an arcuate form, wherein the handle is mounted across each end of the arcuate form. This manufacturing method is simple and cost effective. The handle comprises a handgrip, a handle tube and handle tube inserts. The handgrip comprises an anti-slip sleeve which is preferably constructed out of an elastomer. The handgrip provides a comfortable, anti-slip grip for the user. The handgrip is a sleeve that is straight or contoured on the outer surface. The handle tube provides structural strength and support for the handle. The handle tube inserts comprise cylindrical plugs with threaded holes through the center and are mounted inside the handle tube at each end preferably through means of an adhesive. An alternative to the handle tube and the handle tube inserts is a handle rod with threaded holes at each end with means for fastening the handle rod to the arcuate support member. The handgrip is slid over the handle tube and the ends of the arcuate support member are secured to the handle tube inserts by a fastening means preferably a bolt and a fender washer. Alternative fasteners include screws, rivets, and pins. An alternative manufacturing method of constructing the arcuate support member comprises injection molding, casting, or making the arcuate support member out of wood, and applying an anti-slip, high friction surface to the outer, convex surface of the arcuate support member. Preferably, the additional anti-slip, high friction surface consists of a thin elastomer sheet applied to the outer surface of the arcuate support member by means of an adhesive. Alternatively, the elastomer sheet is substituted with a high friction material that is sprayed onto the outer surface of the rigid arcuate member, forming an anti-slip, high friction coating on the outer, convex surface of the arcuate support member.

DETAILED DESCRIPTION OF THE INVENTION

Figure 1:
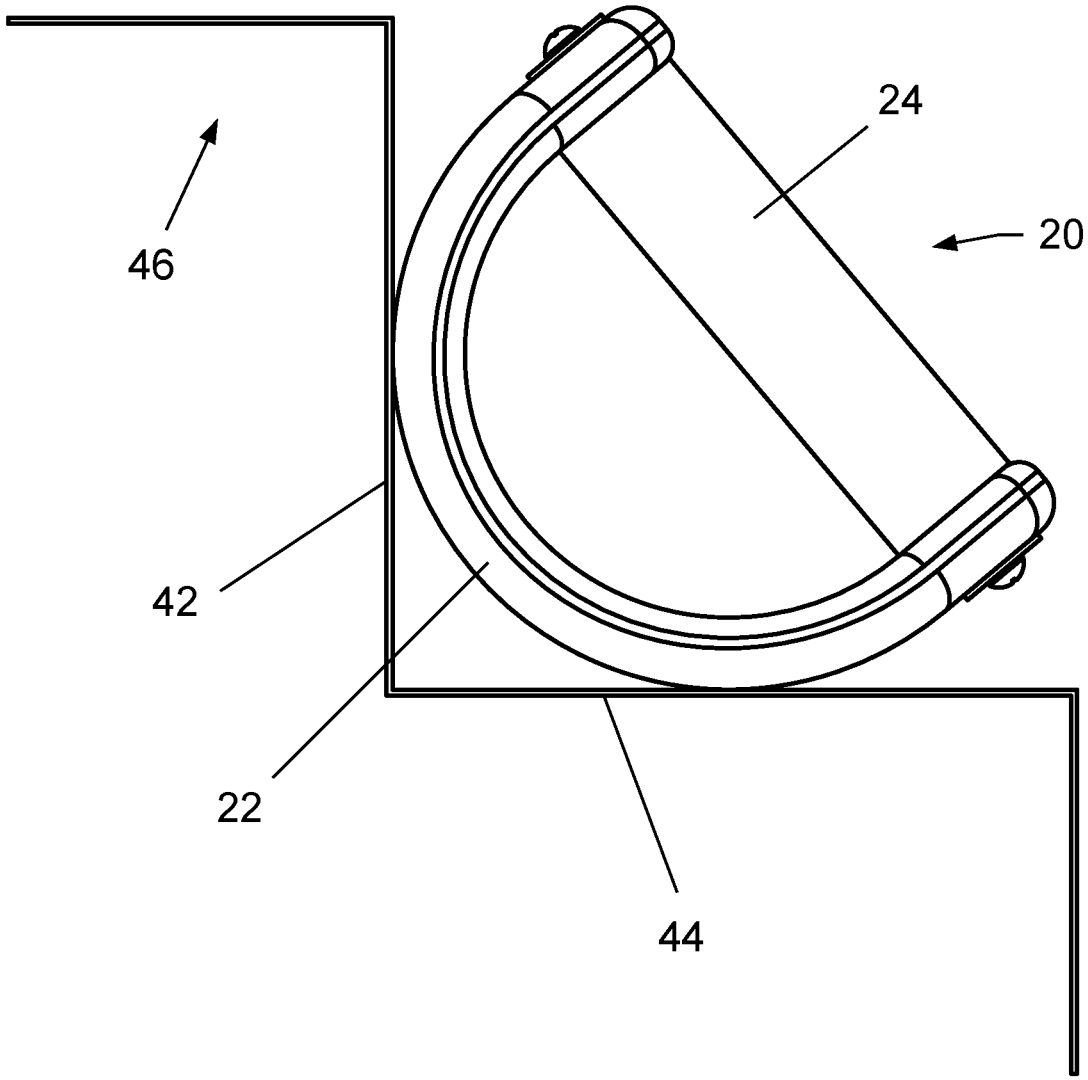
FIG. 1 is a side view of one of the two push-up stands according to the invention.
Figure 2:
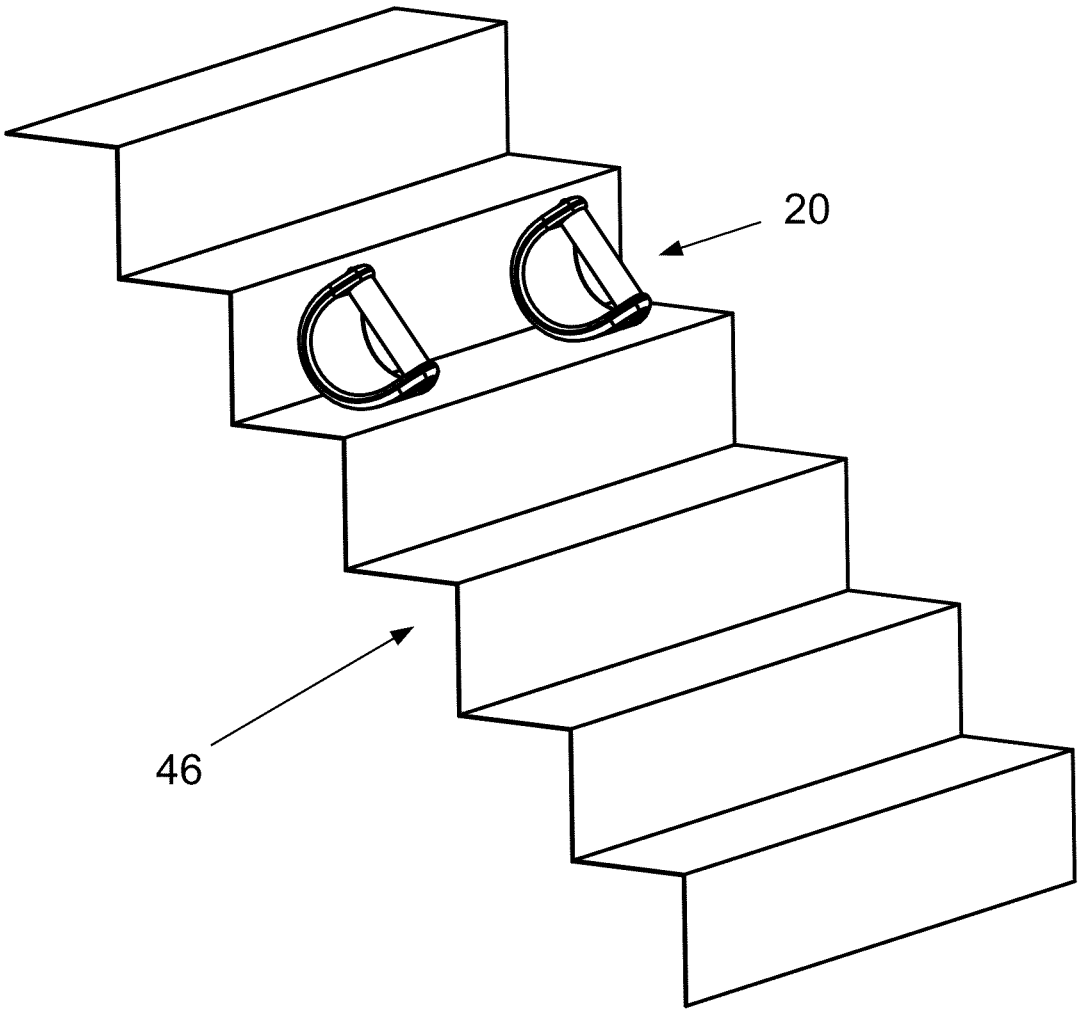
FIG. 2 is a side perspective view of the exercise apparatus positioned for use on stairs.
Figure 3:
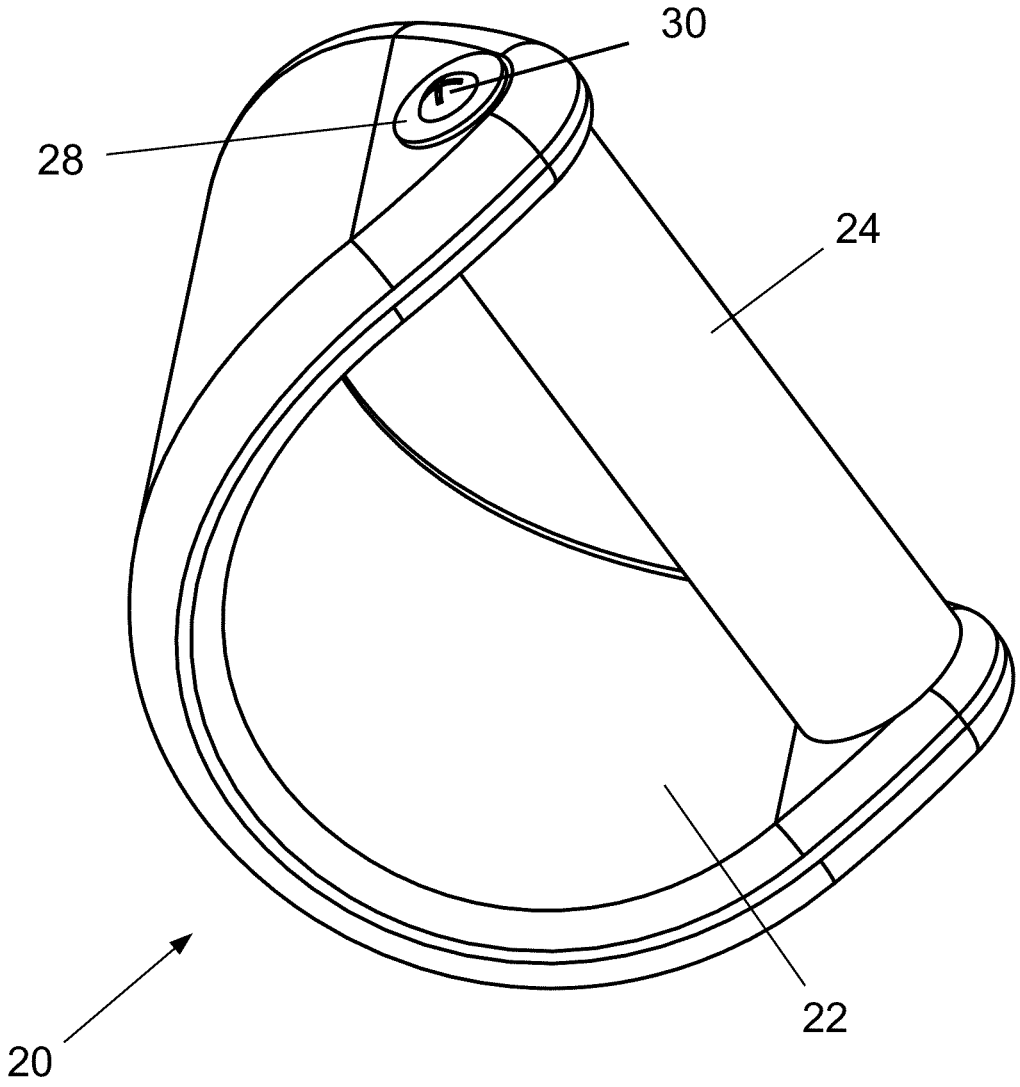
FIG. 3 is a side perspective view of the push-up stand of FIG. 1.
Figure 4:
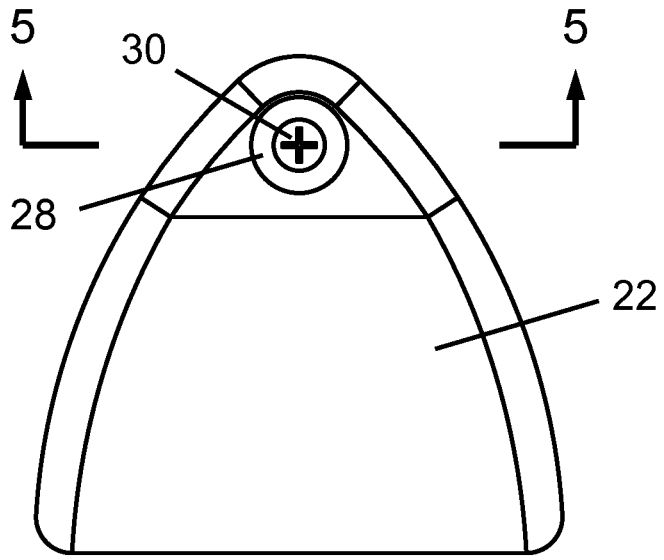
FIG. 4 is a front view of the push-up stand of FIG. 1.
Figure 5:
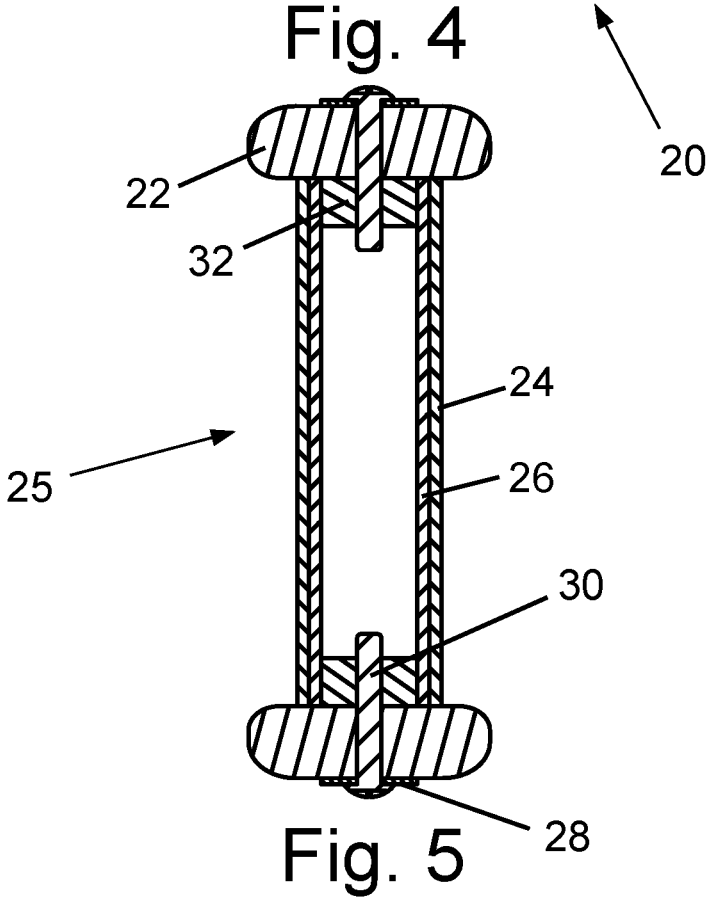
FIG. 5 is a top section view of FIG. 4 showing the handle.
Figure 6A:
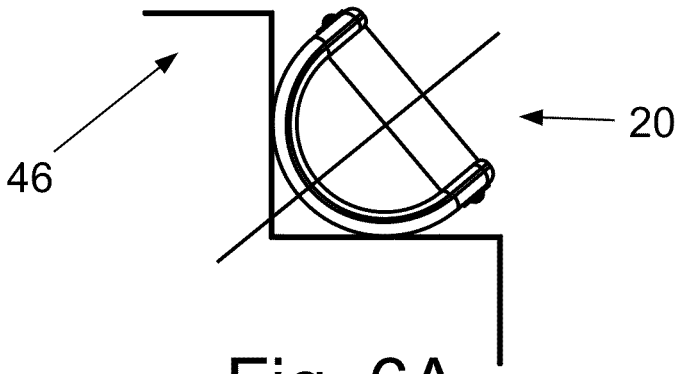
FIGS. 6A, 6B and 6C are side views of the push-up stand of FIG. 1 showing the push-up stand positioned at various angles.
Figure 6B:
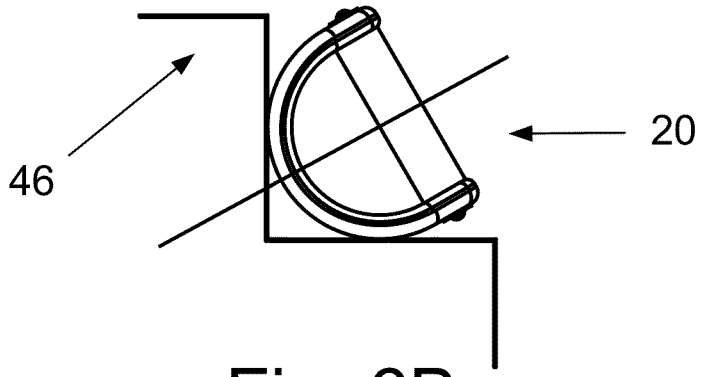
Figure 6C:
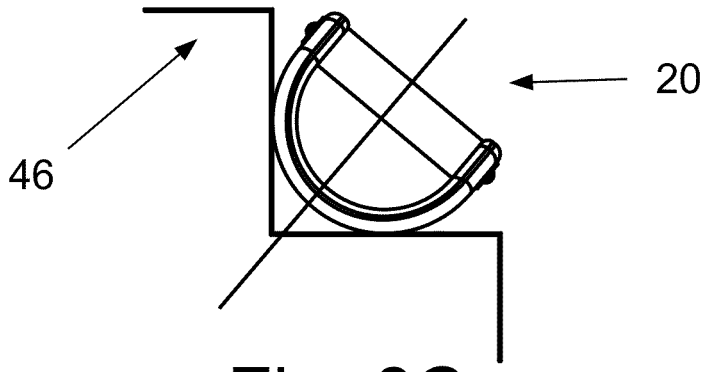
Figure 7:
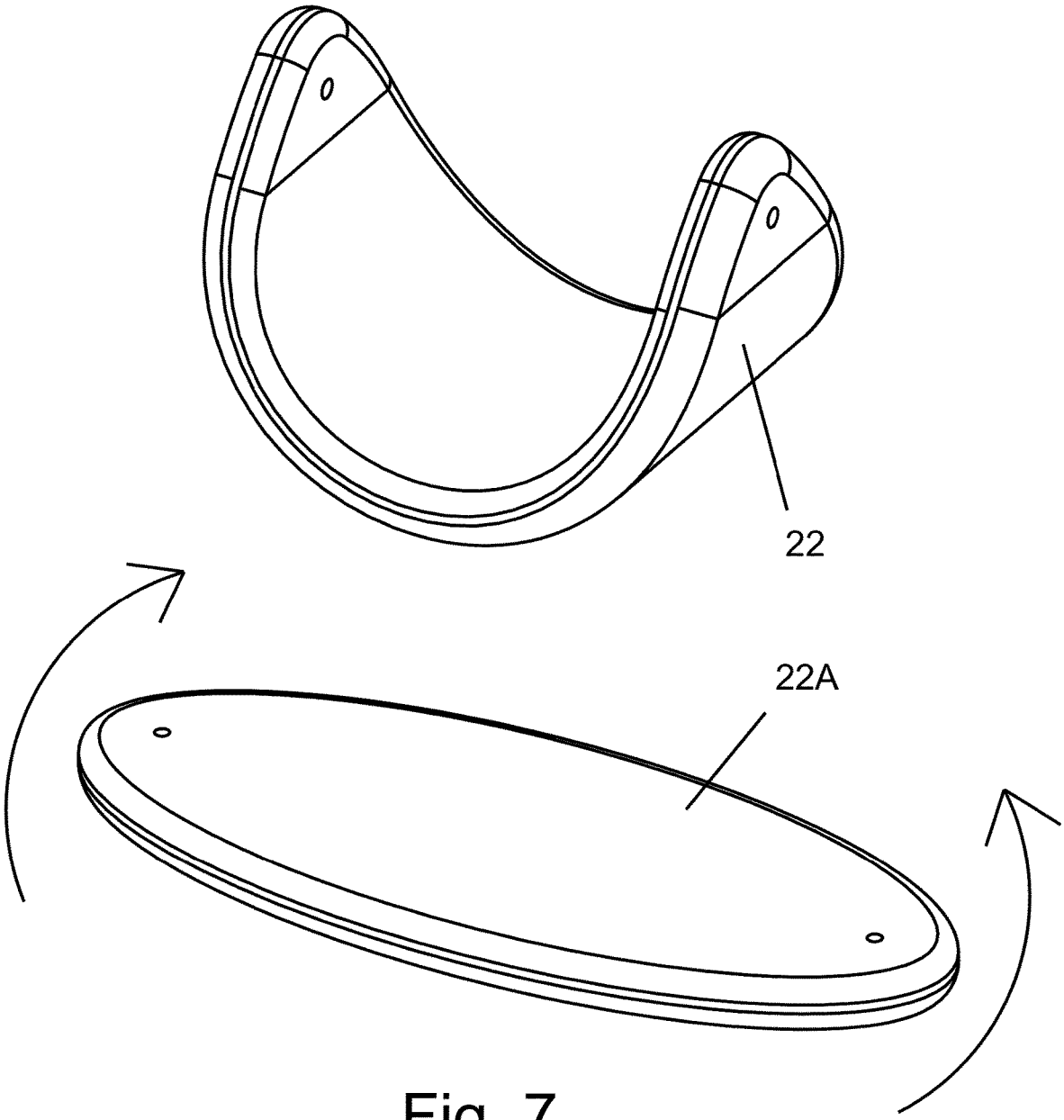
FIG. 7 is a top perspective view showing the preferred manufacturing method for the support member of the push-up stand of FIG. 1 before and after being curved into an arcuate form for construction.
Figure 8:
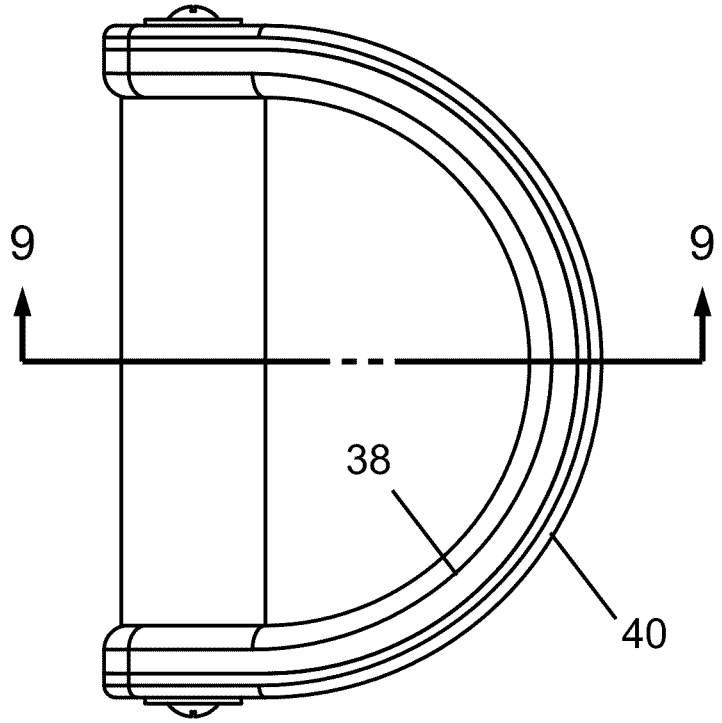
FIG. 8 is a side view of a push-up stand showing an alternative arcuate support member of the invention.
Figure 9:
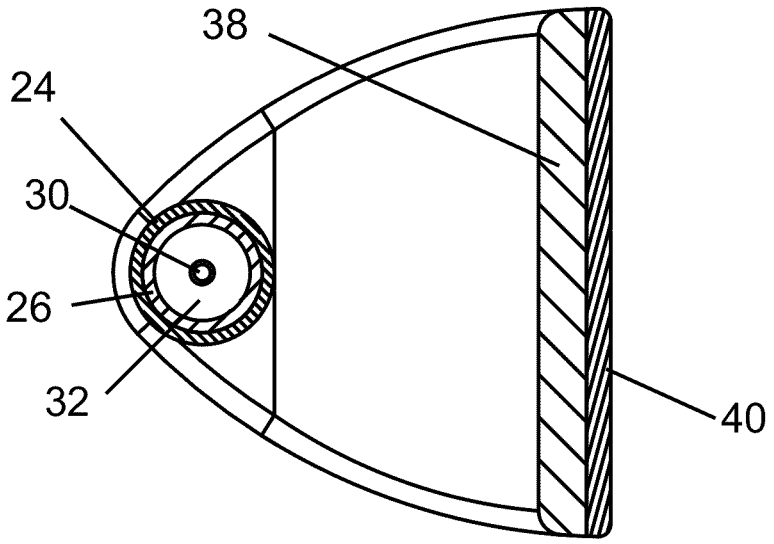
FIG. 9 is a front section view of FIG. 8 showing a rigid arcuate support member with an elastomer outer layer.

FIG. 1 shows one of the two push-up stands according to the invention. Push-up stand 20 includes a handgrip 24 and an arcuate support member 22. Preferably, handgrip 24 is made from an anti-slip elastomer that is comfortable for a user's hand. Handgrip 24 is mounted across opposite ends of arcuate support member 22. Arcuate support member 22 is preferably made from a strong, anti-slip, high friction elastomer. Push-up stand 20 is positioned on an inside corner of conventional stairs 46. Push-up stand 20 is secured against staircase riser 42 and adjacent staircase tread 44 by means of friction. FIG. 2 shows a pair of push-up stands 20 positioned on conventional stairs 46. FIG. 3 shows the preferred shape of arcuate support member 22. Arcuate support member 22 is wide in the center and tapers down as the width approaches handgrip 24. FIG. 4 shows the front view of push-up stand 20. FIG. 5 shows a top section view of handle 25 which comprises handgrip 24, handle tube 26, and handle tube inserts 32. The handle tube inserts 32 are cylindrical with tapped holes in the centers. Handle tube inserts 32 are secured into the ends of handle tube 26 preferably by means of adhesive. Handgrip 24 is slid over handle tube 26 with a tight fit. Handle 25 is secured to arcuate support member 22 by means of bolt 30 which is threaded into handle tube insert 32. Because the preferred material of arcuate support member 22 is an elastomer, fender washer 28 is used to distribute the force of bolt 30 on arcuate support member 22. FIGS. 6A, 6B, and 6C show that push-up stand 20 can be positioned on stairs 46 at different angles. Because push-up stand 20 is held in position against stairs 46 by friction, the user may adjust the angle of push-up stand 20 to the user's comfort and personal preferences. FIG. 7 shows the preferred method of manufacture and pre-assembly of a support member 22A. Support member 22A is cut from a flat elastomer sheet. The ends of support member 22A are curved to form arcuate support member 22. In this position, handle 25 can be mounted across the ends of the arcuate support member 22. Bolt 30 and fender washer 28 are used to secure handle 25 to the arcuate support member 22. FIG. 8 shows an alternative method of manufacturing arcuate support member 22. The alternative method comprises a rigid arcuate support member 38, which is injection molded, cast, or made of wood, and an anti-slip material 40. Preferably, anti-slip material 40 is an elastomer sheet which is secured to the rigid arcuate support member 38 by means of an adhesive. FIG. 9 shows the secured anti-slip material 40 and the rigid arcuate support member 38. A further alternative method of manufacturing arcuate support member 22, not shown, comprises rigid arcuate support member 38 and a spray-on, high friction material. The spray-on, high friction material is sprayed on the outer, convex surface of rigid arcuate support member 38.

The invention claimed is:

1. An exercise apparatus for allowing a user to perform push-ups on an incline, the exercise apparatus comprising:

two push-up stands being individual, each push-up stand being comprised of:

an arcuate support member being substantially non-hemispheric, cut from a blank sheet of rubber, and configured for positioning said push-up stand against a vertical surface and an adjacent horizontal surface, with said vertical surface and said adjacent horizontal surface forming an inside corner;

a handle, rigidly mounted across and through two opposite ends of said arcuate support member; and a means of mounting said handle to said two opposite ends of said arcuate support member;

wherein:

said handle is configured to provide a gripping surface for hands of said user;

said two push-up stands are configured to be positioned laterally by said user; and an angle of said two push-up stands relative to an angle of said incline is configured to be positioned by said user.

2. The exercise apparatus of claim 1, wherein said vertical surface and said adjacent horizontal surface are members of stairs.

3. The exercise apparatus of claim 1, wherein said handle comprises a handgrip, a handle support tube, and handle support tube inserts.

4. The exercise apparatus of claim 3, wherein said handgrip is constructed from a comfortable, anti-slip elastomer.

5. The exercise apparatus of claim 1, wherein said handle comprises a handgrip and a handle support rod.

6. A manufacturing method for a pair of individual push-up stands configured to allow a user to perform push-ups on an incline, each individual push-up stand comprising an arcuate form being substantially non-hemispheric and a handle, said manufacturing method comprising a construction of each said individual push-up stand comprising the following steps:

cutting a blank from a sheet of rubber;

curving ends of said blank into said arcuate form such that said ends of said blank respectively become ends of said arcuate form; and mounting said handle across and through said ends of said arcuate form.

* * * * *